US010723522B1

(12) United States Patent
Staczek

(10) Patent No.: US 10,723,522 B1
(45) Date of Patent: Jul. 28, 2020

(54) HOT CUP LID SYSTEM

(71) Applicant: Roman Staczek, Seminole, FL (US)

(72) Inventor: Roman Staczek, Seminole, FL (US)

( * ) Notice: Subject to any disclaimer, the term of this patent is extended or adjusted under 35 U.S.C. 154(b) by 0 days.

(21) Appl. No.: 16/245,649

(22) Filed: Jan. 11, 2019

Related U.S. Application Data

(63) Continuation-in-part of application No. 14/859,436, filed on Sep. 21, 2015, now abandoned.

(60) Provisional application No. 62/080,673, filed on Nov. 17, 2014.

(51) Int. Cl.
*B65D 43/02* (2006.01)

(52) U.S. Cl.
CPC ..... *B65D 43/0212* (2013.01); *B65D 2543/00046* (2013.01); *B65D 2543/00555* (2013.01); *B65D 2543/00731* (2013.01)

(58) Field of Classification Search
CPC ..... B65D 43/02; B65D 43/0212; B65D 2543/00043; B65D 2543/00046; B65D 2543/00555; B65D 2543/00731; B65D 2543/00093; B65D 2543/00296; A47G 19/2272; A47G 19/2266
USPC ..... 220/703, 713, 711, 715, 780; 229/906.1, 229/404
See application file for complete search history.

(56) References Cited

U.S. PATENT DOCUMENTS

2014/0042177 A1* 2/2014 Fleming ..... B65D 43/02 220/713
2014/0042178 A1* 2/2014 Brannock ..... B65D 47/06 220/713

* cited by examiner

*Primary Examiner* — Elizabeth J Volz

(57) ABSTRACT

A lid has a generally planar top with a front and a rear and sides there between. The planar top is circular with a center. The planar top includes a well section. Walls bound the well section. The walls extend upwardly from a location between the front and the center of the planar top. The walls have a thickness greater than all other regions of the lid. A drink hole is formed in the well section.

3 Claims, 2 Drawing Sheets

FIG. 1
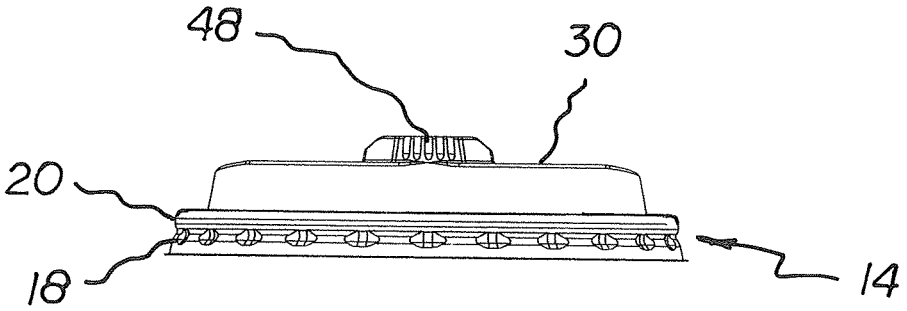
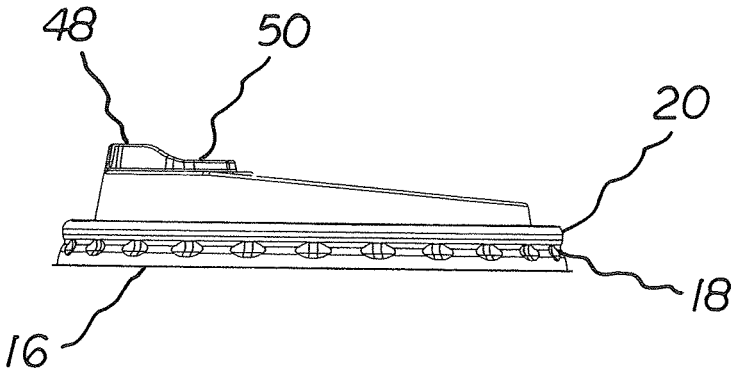
FIG. 2

FIG. 3
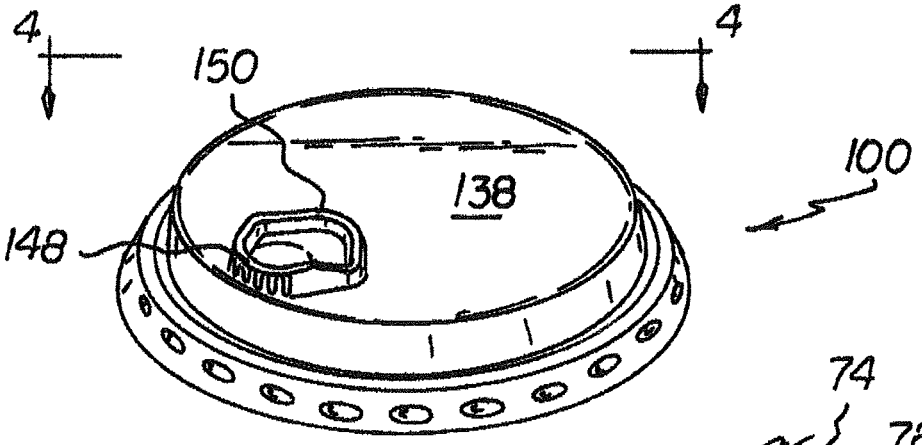
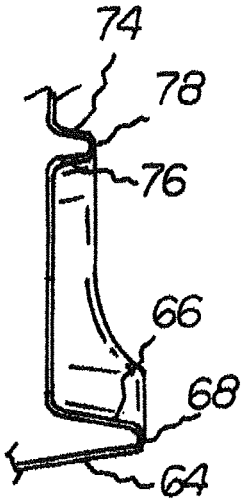
FIG. 5
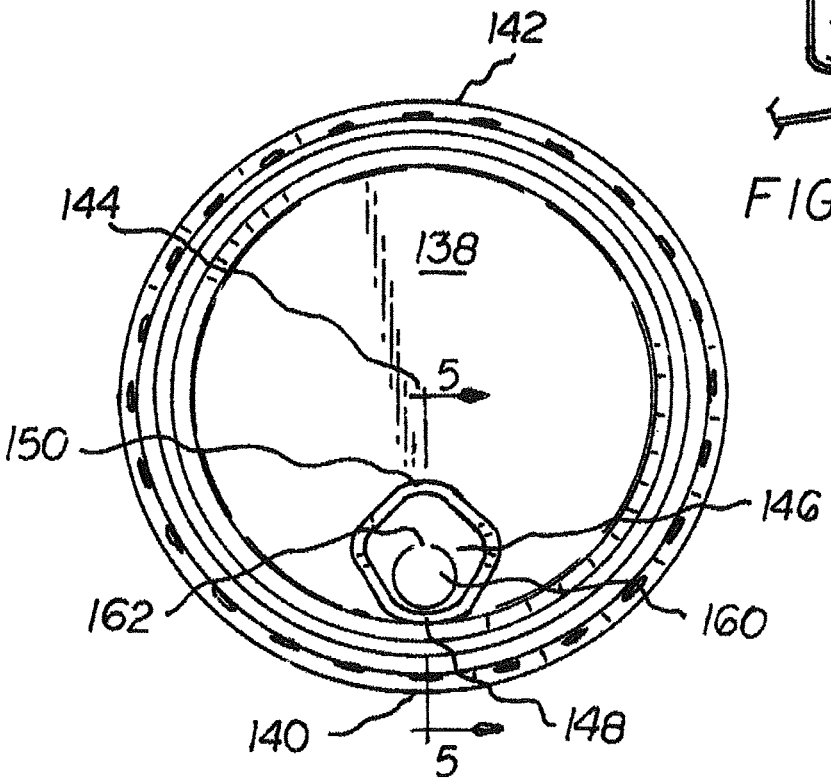
FIG. 4

HOT CUP LID SYSTEM

RELATED APPLICATION

This application is a continuation-in-part of application Ser. No. 14/854,436 filed Sep. 21, 2015 which is based upon Provisional Application No. 62/080,673 filed Nov. 17, 2014, the subject matter of which applications is incorporated herein by reference and the priority of which applications is hereby claimed.

BACKGROUND OF THE INVENTION

Field of the Invention

The present invention relates to a hot cup lid system and more particularly pertains to covering a cup of hot liquid and for facilitating drip-free drinking, the covering and the drinking being done in a safe, clean, convenient, and economical manner.

SUMMARY OF THE INVENTION

In view of the disadvantages inherent in the known types of lid systems of known designs and configurations now present in the prior art, the present invention provides an improved hot cup lid system. As such, the general purpose of the present invention, which will be described subsequently in greater detail, is to provide a new and improved hot cup lid system and method which has all the advantages of the prior art and none of the disadvantages.

From a broad viewpoint, the present invention is a hot cup lid system. A lid has a top with a well section. Walls bound the well section. The walls have a thickness greater than all other regions of the lid. A drink hole is formed in the well section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hot cup lid system which has all of the advantages of the prior art lid systems of known designs and configurations and none of the disadvantages.

It is another object of the present invention to provide a new and improved hot cup lid system which may be easily and efficiently manufactured and marketed.

It is a further object of the present invention to provide a new and improved hot cup lid system which is of durable and reliable constructions.

An even further object of the present invention is to provide a new and improved hot cup lid system which is susceptible of a low cost of manufacture with regard to both materials and labor, and which accordingly is then susceptible of low prices of sale to the consuming public, thereby making such hot cup lid system economically available to the buying public.

Lastly, another object of the present invention is to provide a hot cup lid system for covering a cup of hot liquid and for facilitating drip-free drinking, the covering and the drinking being done in a safe, clean, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a hot cup lid system constructed in accordance with the principles of the present invention.

FIG. 2 is side elevational view of the hot cup lid system illustrated in FIG. 1.

FIG. 3 is a perspective illustration of the hot cup lid system of the prior Figures.

FIG. 4 is a plan view of the hot cup lid system taken along line 4-4 of FIG. 3.

FIG. 5 is a cross sectional view taken along line 5-5 of FIG. 24

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved hot cup lid system embodying the principles and concepts of the present invention and generally designated by the reference numeral 10 will be described.

The present invention, the hot cup lid system 10 is comprised of a plurality of components. Such components in their broadest context include a lid having a generally planar top with a front and a rear and sides there between. The planar top is circular with a center. The planar top includes a well section. Walls bound the well section. The walls extend upwardly from a location between the front and the center of the planar top. The walls have a thickness greater than all other regions of the lid. A drink hole is formed in the well section.

Such components are individually configured and correlated with respect to each other so as to attain the desired objective.

From a specific viewpoint, the present invention is a hot cup lid system 10. First provided is a lid 12 with a coupling section 14. The coupling section has a planar lower edge 16. The planar lower section has a diameter of 3.660 inches, plus or minus 10 percent. The lower edge being is horizontal in orientation during use prior to drinking. The cup coupling section has a concave ring 18. The concave ring is provided above the lower edge. The concave ring has a diameter of 3.451 inches, plus or minus 10 percent. The cup coupling section also has a convex ring 20. The convex ring is provided above the concave ring. The convex ring has a diameter of 3.501 inches, plus or minus 10 percent. The cup coupling section has a forward point. The cup coupling section has a rearward point. The cup coupling section is adapted to facilitate coupling to a cup of hot liquid.

As may be seen in the Figures, the lid 100 has a generally planar top 138 with a front 140 and a rear 142 and sides there between. The planar top is circular with a center 144. The planar top includes a well section 146. The well section is bounded by walls. The walls extend upwardly from a location between the front and the center of the planar top. The walls include a forward wall 148 and a rearward wall 150 with side walls there between. The walls together are formed as a polygon. The forward wall extends upwardly from the planar top to a first height. The rearward wall extends upwardly from the planar top to a second height. The first height is greater than the second height with the side walls at a sloping height.

The walls have a common cross sectional configuration throughout the forward wall and the rearward wall and the side walls. Note FIG. 5. Such walls, in V-shaped configuration, have sloping sides externally 64, 74 and internally 66, 76 and horizontal tops 68, 78.

The well section is formed with a drink hole and cover 160 and coupling tab 162. The drink hole is circular. The drink hole is located closer to the forward wall than to the rearward wall. The system is fabricated of plastic.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cup lid system comprising:

a lid having a generally planar top with a front and a rear and sides there between, the planar top being circular with a center, the planar top includes a well section;

walls bounding the well section, the walls extending upwardly from a location entirely between the front and the center of the planar top, the walls including a semi-circular forward wall and a semi-circular rearward wall with side walls there between, the walls together being formed as a polygon, the forward wall extending upwardly from the planar top to a first height, the rearward wall extending upwardly from the planar top to a second height, the first height being higher than the second height with the side walls at a sloping height;

the walls having a common cross sectional configuration throughout the forward wall and the rearward wall and the side walls, the forward wall and the rearward wall and the side walls being in an inverted generally V-shaped configuration, in cross section, with sloping sides externally and internally and horizontal tops, and a drink hole formed in the well section, the drink hole being circular, the drink hole being located closer to the forward wall than to the rearward wall, the system is fabricated of plastic.

2. A lid formed with a circular periphery and a center, a horizontal mid-lid dividing the lid into an upper semi-circle and a similarly configured lower semi-circle, a vertical mid-line divides the lower semi-circle into a left quarter-circle and a similarly configured right quarter-circle;

a peripheral lip formed in the lid, the peripheral lip having an inverted U-shaped configuration for removably positioning on a cup;

a drink hole formed in the lower semi-circle spanning the left quarter-circle and the right quarter-circle, the drink hole being closer to the periphery than to the center; and a wall formed totally within in the lower semi-circle spanning the left quarter-circle and a right quarter-circle, the wall having linear side sections and a semi-circular upper section and a semi-circular lower section, the wall completely encircling the drink hole, the wall having in inverted U-shaped configuration, the wall extending upwardly from the drink hole and the remainder of the lid.

3. The system as set forth in claim 2 wherein the wall has a first section adjacent to the periphery at a first height, the wall having a second section adjacent to the center at a second height, the first height being higher than the second height.

* * * * *